US005547031A

United States Patent [19]

Warren et al.

[11] Patent Number: 5,547,031

[45] Date of Patent: Aug. 20, 1996

[54] ORIENTATION CONTROL MECHANISM

[75] Inventors: Tommy M. Warren, Coweta; Houston B. Mount, Tulsa, both of Okla.

[73] Assignee: Amoco Corporation, Chicago, Ill.

[21] Appl. No.: 394,134

[22] Filed: Feb. 24, 1995

[51] Int. Cl.[6] ..... E21B 7/06

[52] U.S. Cl. ..... 175/61; 175/73

[58] Field of Search ..... 175/61, 73, 325.3

[56] References Cited

U.S. PATENT DOCUMENTS

| | | | |
|---|---|---|---|
| 3,023,821 | 3/1962 | Etherington | 175/61 X |
| 3,062,303 | 11/1962 | Schultz | 175/73 X |
| 3,276,824 | 10/1966 | Carter | 175/325.3 |
| 3,352,370 | 11/1967 | Livingston | 175/325.3 |
| 3,370,657 | 2/1968 | Antle | 175/73 X |
| 4,076,084 | 2/1978 | Tighe | 175/73 |
| 4,220,213 | 9/1980 | Hamilton | 175/73 X |
| 4,284,154 | 8/1981 | England | 175/325 |
| 4,416,339 | 11/1983 | Baker et al. | 175/61 |
| 4,638,873 | 1/1987 | Welborn | 175/73 |
| 4,699,224 | 10/1987 | Burton | 175/61 |
| 4,715,453 | 12/1987 | Falgout, Sr. et al. | 175/73 |
| 4,739,843 | 4/1988 | Burton | 175/73 |
| 4,770,258 | 9/1988 | Falgout, Sr. | 175/73 |
| 4,899,833 | 2/1990 | Warren et al. | 175/45 |
| 4,947,944 | 8/1990 | Coltman et al. | 175/73 |
| 4,948,925 | 8/1990 | Winters et al. | 175/48 |
| 5,131,479 | 7/1992 | Boulet et al. | 175/73 |
| 5,181,576 | 1/1993 | Askew et al. | 175/61 |
| 5,186,264 | 2/1993 | duChaffaut | 175/27 |
| 5,232,058 | 8/1993 | Morin et al. | 175/73 |
| 5,265,684 | 11/1993 | Rosenhauch | 175/61 |

FOREIGN PATENT DOCUMENTS

| | | |
|---|---|---|
| 673720 | 7/1974 | U.S.S.R. . |
| 922263 | 4/1982 | U.S.S.R. . |
| 927948 | 5/1982 | U.S.S.R. . |
| 1617127 | 12/1990 | U.S.S.R. . |

*Primary Examiner*—Hoang C. Dang
*Attorney, Agent, or Firm*—James A. Gabala; Robert E. Sloat

[57] ABSTRACT

In a curve drilling assembly having a mandrel rotatably mounted within a cylindrical sleeve, an apparatus and method of using the apparatus are disclosed for orienting the sleeve of a curve drilling system and for shifting modes of operation of a curve drilling system from a steering mode to a straight drilling mode. The apparatus comprises: a drilling fluid powered blade that is carried by the sleeve for engaging the walls of a curved borehole and inducing counter-clockwise rotation of the sleeve; and a valve, carried within the mandrel, for operating the blade by introducing pressurized drilling fluid from the interior of a drill string connected to the mandrel.

20 Claims, 6 Drawing Sheets

ORIENTATION CONTROL MECHANISM

TECHNICAL FIELD

This invention relates to the general subject of oil well and gas well drilling and, in particular, to apparatus and methods used to drill a curved wellbore in the surface of the earth.

BACKGROUND OF THE INVENTION

Lateral wellbores, or "laterals", offer the potential to drain more oil than would be recovered otherwise. For example, laterals may be used to tap fresh oil by intersecting fractures, penetrating pay discontinuities, and draining up-dip traps. Lateral re-completions can also correct production problems such as water coning, gas coning, and excessive water cuts from hydraulic fractures which extend below the oil-water interface. Moreover, synergistic benefits may result from coupling lateral recompletions with enhanced recovery techniques to solve conformance problems, to contact unswept oil by recompleting injection wells, and to redirect sweep by converting existing well patterns into line-drive configurations. Finally lateral recompletion strategies can take advantage of current production infrastructure, capital resources of existing wellbores, known resources of oil in place, and secondary and tertiary recovery technology.

One major impediment to the widespread use of lateral re-entries is the need to keep the cost of drilling and completing laterals as low as possible. Workover economics in mature fields require substantial cost reductions over the methods most often used for drilling new horizontal wells. Thus, there is a great need for a reliable reduced-cost drilling system that utilizes the equipment and cost structures of workover and repair services.

In addition, to the economic constraints, there are technical limitations. For a curve drilling system to be technically successful it should preferably drill a consistent radius of curvature and drill the curve in the desired direction. This is because it is highly desirable to:

- Position the end of the curve within a precise depth interval so the lateral can traverse the pay zone as desired.
- Place the lateral in a direction dictated by well spacing, desired sweep pattern, or other geological considerations.
- Establish a smooth wellbore to facilitate drilling the lateral and completing the well.

Rotary-steerable drilling systems are one category of curve drilling systems. The downhole components of such systems often include a curve assembly, flexible drill collars, and orientation equipment. The curve assembly is relatively short and incorporates a flexible joint that is pushed to one side of the wellbore to tilt the drill bit. Orientation equipment typically comprises a standard mule-shoe sub for magnetic orientation. This basic system concept has been around for decades; however problems with angle build and directional control have limited its commercial success.

Several tools have been disclosed for drilling a curved borehole. U.S. Pat. Nos. 4,699,224 and 4,739,843 to Burton (and assigned to Amoco Corporation) disclose one basic curve drilling assembly. U.S. Pat. No. 5,213,168 to Warren et. al. (also assigned to Amoco Corporation) describes an alternative and improved curved drilling assembly. Consistent performance in the Warren tool was achieved, in part, by stabilizing the drill bit to continually point along a curved path and designing the bit so that it cuts only in the direction it is pointed. In particular, improved bit stability was achieved by using a "low-friction gauge" technique. (See, for example, U.S. Pat. Nos. 5,010,789 and 5,042,596 to Brett et. al. and assigned to Amoco Corporation). The drill bit cutters are positioned so that they direct a lateral force toward a smooth pad on the side or gauge portion of the drill bit. The pad contacts the borehole wall and transmits a restoring force to the drill bit. This force rotates with the bit and continually pushes one side of the drill bit (i.e., the one that does not have a gauge cutting structure) against the borehole wall. When such a drill bit is used, the curve drilling assembly drills a curved path by continually pointing the drill bit along a line that is tangent to the curved path. The assembly runs smoothly, the hole is uniform in diameter, and the effects of varying lithology are negated. Moreover, the cost to manufacture such an assembly, including the anti-whirl drill bit, is much less than that for a curve drilling assembly that uses a mud motor.

Although the drilling system described in U.S. Pat. No. 5,213,168 drills true, it must be oriented in the desired direction. In particular, many such drilling systems make use of an eccentric deflection sleeve to direct the lower portion of the drillstring and to tilt the drill bit. The orientation of the sleeve determines the azimuth of the curve. Thus, the sleeve must be initially oriented in the target direction and its orientation must be monitored and adjusted (if necessary) as drilling progresses (e.g., because the sleeve may slip and require repositioning.)

U.S. Pat. No. 4,948,925 to Winters, Burton, Warren and Brett (and assigned to Amoco Corporation) describes one apparatus and method for rotationally orienting a borehole engaging means or deflection sleeve. In particular, the sleeve is oriented by turning the drillstring counter-clockwise to have a spring-loaded latch on the mandrel engage a pocket on the sleeve. Further rotation of the drillstring moves the sleeve to the desired orientation. Thereafter, when the drillstring is rotated clockwise for normal drilling, the latch disengages and the sleeve remains in its adjusted position.

U.S. Pat. No. 4,899,833 to Warren and Winters (and assigned to Amoco Corporation) describes one means by which the orientation of a downhole steering assembly is communicated to the drilling engineers at the wellhead. In particular, a downhole valve is used,,to provide a signal at the wellhead to assist in orienting the deflection sleeve. When a reference point on the drillstring is aligned with the maximum eccentricity of the sleeve, the valve reduces the pump pressure by porting fluid above the drill bit. The valve comprises a slotted stationary ring attached to the deflection sleeve and a rotating port in the mandrel that passes through the sleeve. For simplicity of operation, the reference points are aligned and the latch engages at the same time.

Although the above-described drilling systems have many advantages over the prior art and have found commercial success, experience has shown that there is still room for improvement and further development. In particular, improvement is needed in the efficiency and means by which the drill string is oriented in response to operations conducted by drilling engineers at the well head.

SUMMARY OF THE INVENTION

In accordance with the present invention, an apparatus and method of using the apparatus are disclosed for orienting the sleeve of a curve drilling system and for shifting modes of operation of a curve drilling system from a steering mode to a straight drilling mode. The apparatus comprises a drilling fluid powered blade that is carried by the sleeve for moving to engage the walls of a curved borehole and inducing counter-clockwise rotation of the sleeve when a drill string connected to the mandrel is rotated; and valve means, carried within the mandrel, for moving the blade towards the walls by introducing pressurized drilling fluid from the interior of a drill string connected to the mandrel.

In one embodiment, the blade has a distal generally straight edge and a proximate end surface. The edge lies in a plane that is at an angle to the longitudinal axis of the sleeve such that, when the edge engages the walls of the borehole and the sleeve is rotated in the clockwise direction, (when viewed from the up-hole end of the sleeve), the sleeve is driven into the borehole. The end surface of the blade is sealingly carried within a cavity in the sleeve for movement towards and away from the longitudinal axis in response to the introduction of drilling fluid into the cavity and against the end surface of the blade.

In one embodiment, the valve means comprises: a plug, biasing means for the plug, pressure activated means and pressure control means. The plug is slidingly mounted within the bore of the mandrel for respectively closing and opening a passage-way joining the interior of the mandrel and the cavity in the sleeve that carries the end surface of the blade. The biasing means is carried by the mandrel and biases the plug to its closed position. The pressure activated means is carried within the bore of the mandrel and acts to overcome the biasing means and move the plug to its opened position in response to increasing the pressure of the drilling fluid supplied to the bore of the mandrel by a pre-determined amount above a nominal value. The pressure activated means has an opening through which drilling fluid passes in flowing between the ends of the mandrel. The pressure control means is carried within the bore of the mandrel and functions to plug partially the opening of the pressure activated means and increase the pressure within the bore to at least the pre-determined amount when the plug is in its open position so as to keep the passage-way pressurized after the pressure of the drilling fluid supplied to the bore returns to its nominal value.

One important advantage of the invention is that reorientation/rotation of the eccentric sleeve of a curve drilling assembly is achieved without having to rotate the entire drill string. In particular, the sleeve can be rotated counter-clockwise without counter-clockwise rotation of the drill string. Counter-clockwise rotation is undesirable since it tends to loosen the threaded connections that hold the drill string together.

Numerous other advantages and features of the present invention will become readily apparent from the following detailed description of the invention, the embodiments described therein, from the claims, and from the accompanying drawings.

DETAILED DESCRIPTION

Figure 1:
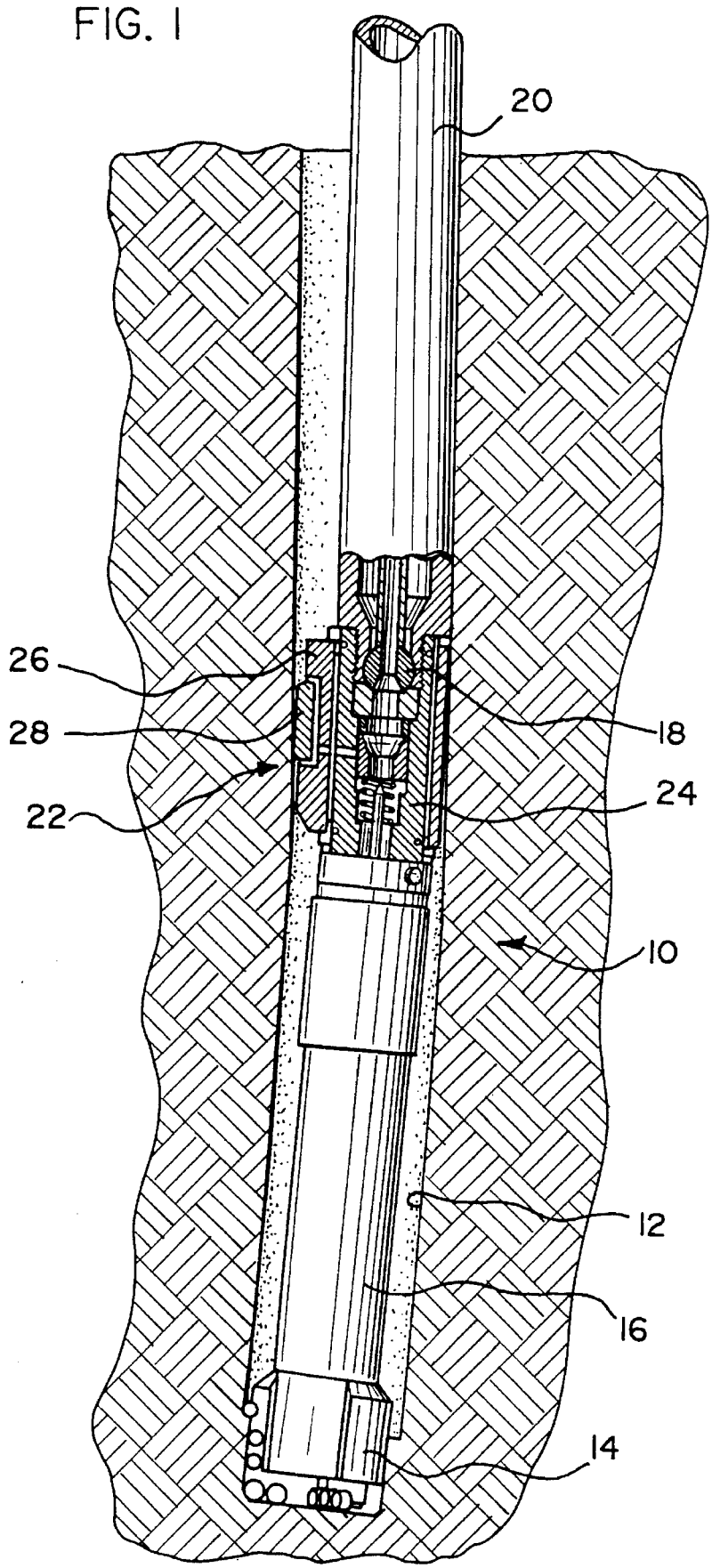
FIG. 1 is a partial, cross-sectional elevational view of a curve drilling assembly that incorporates the present invention.

While this invention is susceptible of embodiment in many different forms, there is shown in the drawings, and will herein be described in detail, several specific embodiments of the invention. It should be understood, however, the the present disclosure is to be considered an exemplification of the principles of the invention and is not intended to limit the invention to any specific embodiment illustrated.

Turning to FIG. 1, a curve drilling assembly 10 is shown located in a borehole 12. The assembly 10 comprises a rotary drill bit 14, a drill bit collar 16, a flexible joint 18, and the downhole end of a string of drill pipe 20 (flexible or rigid). The upper-end of the drill bit collar 16 carries a curve guide means 22. The curve guide means comprises a mandrel 24 and a housing 26. The mandrel is carried by the drill bit collar 16 and rotates with it. The housing 26 is in the form of an eccentric cylindrical collar or sleeve and carries borehole engaging means 28 (sometimes called a "razor-back"). As the name implies, the borehole engaging means 28 engages the sidewalls of the borehole 12.

The eccentrically shaped housing 26 is mounted for rotational movement relative to the mandrel 24. The thicker wall on one side of the housing 26 forces the flexible joint 18 to the opposite side of the wellbore (i.e., the right hand side according to the orientation of FIG. 1) which causes the drill bit 14 to pivot about the flexible joint 18 in the opposite direction. The borehole engaging means 28 is mounted on the outside surface of the thicker wall of the eccentric sleeve 26.

Although the borehole engaging means 28 is designed to prevent the cylindrical eccentric collar 26 from rotating with the drill string during drilling, friction between the eccentric collar and drill string, downhole vibration and movement occurring during drilling all tend to rotate the collar, thereby resulting in the need to reorient the eccentric collar periodically. Normally, the borehole engaging means 28 is oriented to the high side of the wellbore (i.e., the side of the wellbore closest to the surface of the earth, in order to drill a vertically planar curve).

Figure 2:
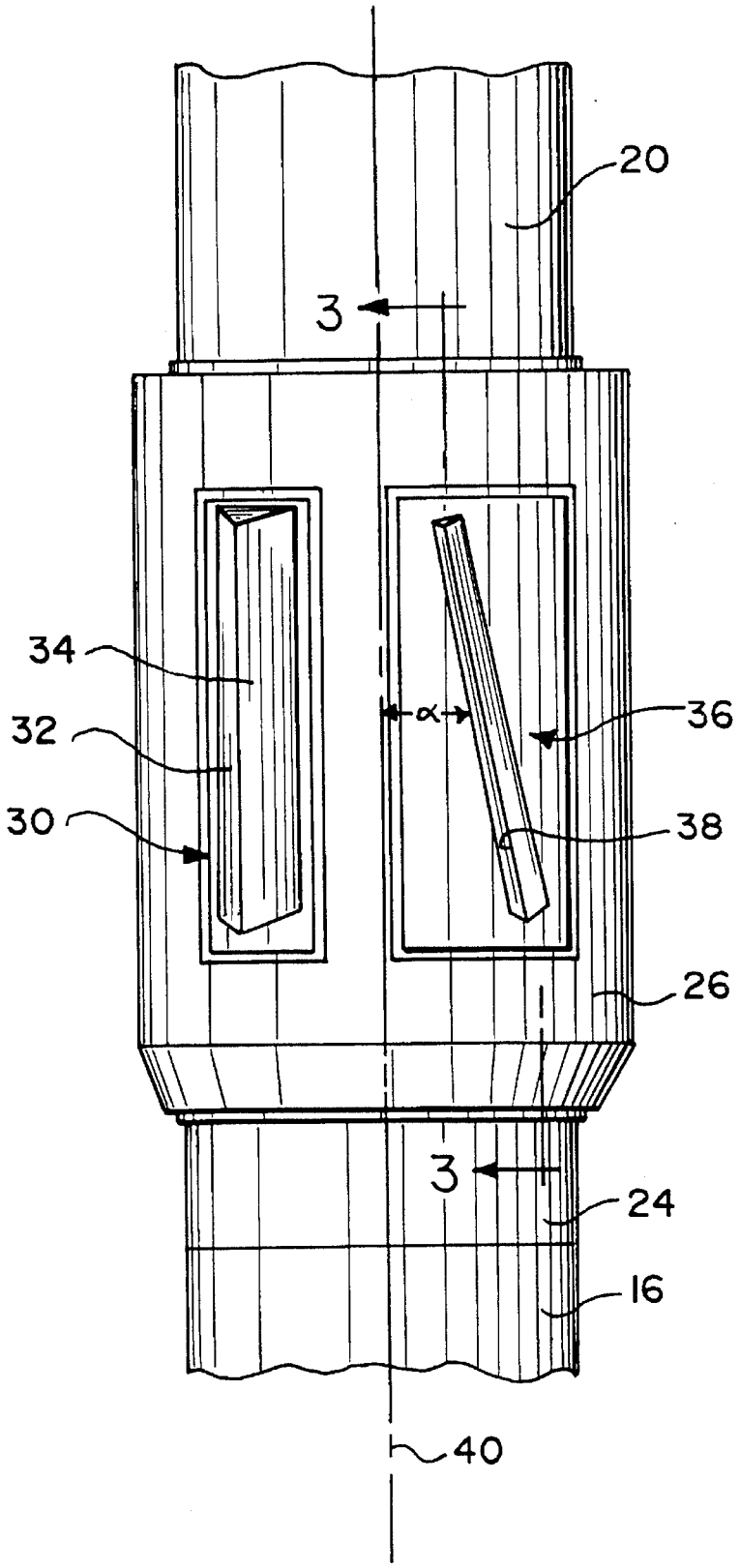
FIG. 2 is an exterior elevational view of two borehole engaging blades.

Turning to FIG. 2, two borehole engaging blades are illustrated. One comprises a spring-loaded blade 30 that has a leading edge 32 which engages the borehole wall when the mandrel 24 and drill string are rotated clockwise. However, when the drill string and mandrel are rotated in the opposite direction, the force of the walls of the borehole 12 on an inclined surface 34 of the blade 30 overcomes the spring force, thereby allowing the housing to rotate along with the drill string. From a functional point of view, this blade 30 is much like the razorback described in U.S. Pat. Nos. 4,699,224 and 4,739,843 which are hereby incorporated by reference. Its primary purpose is to allow rotation of the eccentric sleeve 26 in one direction (i.e., the counter-clockwise direction when viewed from the uphole end of the borehole).

Figure 4:
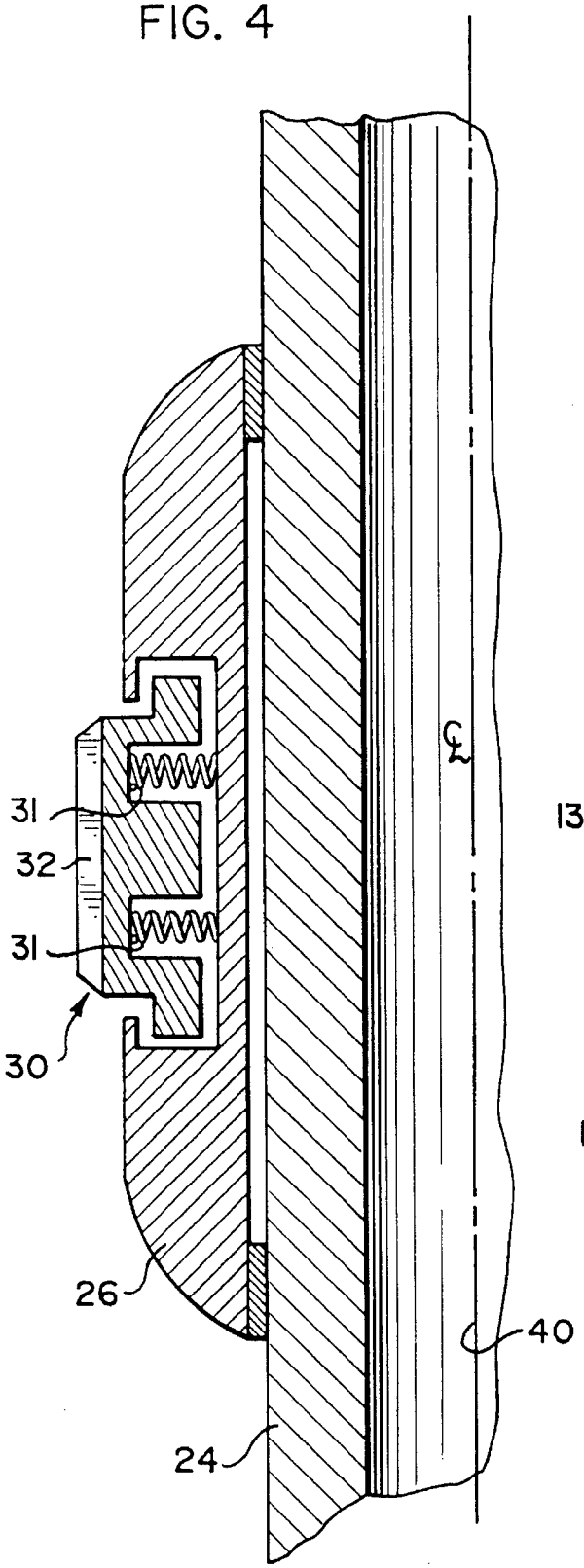
FIGS. 4, 5 and 6 are cross-sectional elevational views of two other borehole wall engaging blades.

FIG. 4 illustrates the details of an improved rotation preventing blade. Instead of small tangentially disposed leaf springs, this apparatus uses coil compression springs to force the leading edge 32 outwardly and away from the body of the eccentric sleeve 26. The coil springs provide added force that is particularly advantageous when drilling in gumbo formations. Additional force may also be achieved by using a large leaf spring that is mounted axially on the eccentric sleeve 26. Resistance to clockwise rotation can be achieved by tilting the leaf spring relative to the centerline of the sleeve.

Figure 3:
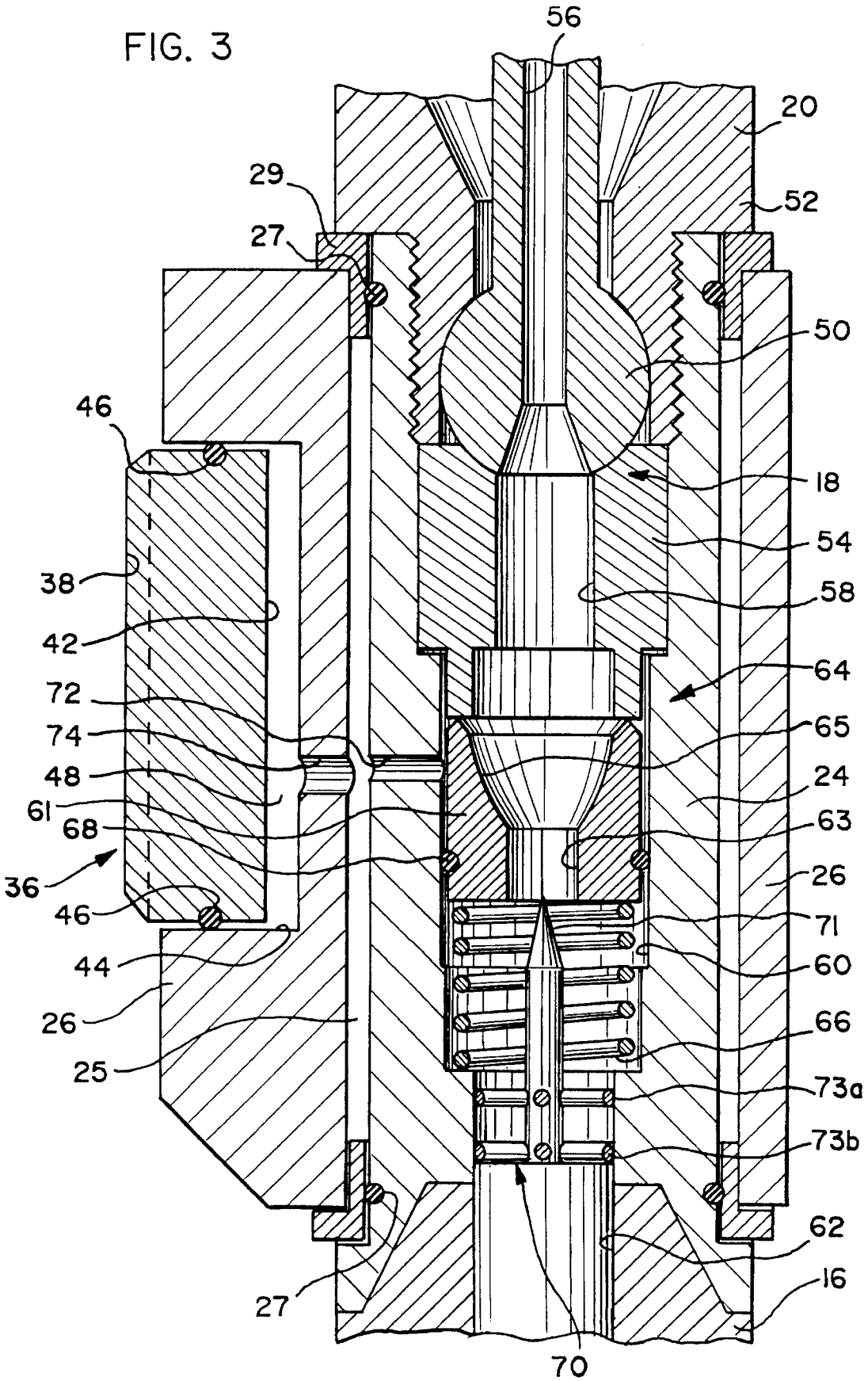
FIG. 3 is a cross-sectional elevational view of the invention as viewed along line 3—3 of FIG. 2.

The other blade 36 is structurally and functionally different. Referring to FIG. 3, this blade 36 has a distal or outer-directed generally straight edge which is inclined or skewed at angle α to a flat plane containing the longitudinal axis 40 of the housing 26 to define a pitch less than 30 feet. The opposite, proximate or interior end 42 is generally flat and fits movingly within a complementary cavity 44 on the exterior of the housing 26. The cavity 44 walls and the interior end 42 of the blade 36 form a hollow chamber 48. Seals 46 are used to close-off the chamber 48 from the exterior of the housing 26 while allowing for movement of the blade 36. The exterior of the mandrel 24 and the interior surface of the eccentric sleeve 26 form a circumferential annulus 25. Seals 27 are used to prevent leakage while allowing relative rotation between the eccentric sleeve 26 and the mandrel 24. The skew of the blade's edge 38 induces counter-clockwise rotational torque to the eccentric sleeve 26 when the drill string is moved downwardly into the borehole while the repositioned or moved blade engages the walls of the borehole 12.

In FIG. 3, the flexible joint 18 comprises a ball-shaped member 50 which is connected to the downhole end of the main body 20 of the drill string, and a complementary socket or spherical housing carried at the uphole end of the mandrel 24 and formed by an upper member 52 and a lower member 54. The ball-shaped member 50 has an interior bore 56 therethrough. The lower member 54 of ball socket has a bore 58 between its ends. Similarly, the mandrel 24 and the drill bit collar 16 have bores 60 and 62 between their ends. Thus, drilling fluid or mud is free to pass from the upper end of the drill string through the interior of the flexible joint 18 and down to the drill bit 14 (See FIG. 1).

A drilling fluid pressure responsive valve 64, carried within the mandrel 24 is used to control the flow of drilling fluid from the interior of the drill string to the blade actuation chamber 48. In particular, the valve 64 comprises: an axially movable valve plug 61 that is carried within the bore 60 of the mandrel 24, a biasing spring 66 for biasing the plug towards the upper end of the mandrel, means 68 for sealing movement between the exterior of the valve plug and the interior wall of mandrel, a bore pressure control element 70, and a valve port 72. The valve port 72 joins the interior bore 20 of the mandrel 24 to the exterior of the mandrel. Another passageway or port 74 joins the exterior of the mandrel 24 to the cavity 44 on the eccentric sleeve 26.

When the plug 64 is positioned as shown in FIG. 3, the mandrel valve port 72 is closed and pressurized fluid from the interior of the drill string is prevented from entering the blade cavity 44. This keeps the blade 36 extended. Leakage will allow the blade 36 to retract. If necessary a small bleed hole can be provided to ensure the blade retracts after the valve port 72 closes.

The valve plug 61 has an internal exit bore 63 and an entry throat 65 against which the drilling fluid exerts a downward force. The geometry of the throat 65, the size of the central bore 63 of the valve plug 61, and the biasing spring 66 are designed such that a predetermined increase (e.g., 20% increase) in drilling fluid pressure above its normal value will force the valve plug downwardly to open the mandrel valve port 72. Opening the mandrel valve port 72 forces fluid into the blade actuation chamber 48 to move the blade 36 outwardly and into engagement with the walls of the borehole 12.

The pressure control element 70 is mounted at the center of the bore 62 at the lower end of the mandrel 24. It comprises a central flow element 71 and two spider-shaped mounting rings **73*a* and 73*b*. The shape and size of the pressure control element 70 and the exit bore 63 are selected such that, when the valve plug 61 is moved to its lowered position (i.e., valve port 72 is open), the valve plug will stay in that position after the pressure of the drilling fluid is returned to its normal value. Effectively, the flow element 71 reduces the size of the value plug exit bore 63 (i.e., like a slideable orifice) and increases the pressure on the entry throat 65 of the valve plug 61. Afterwards, when the pressure of the drilling fluid is reduced temporarily below its nominal value, the spring force of the biasing spring 66 will move the valve plug 61 upwardly and close the valve port 72**.

Figure 5:
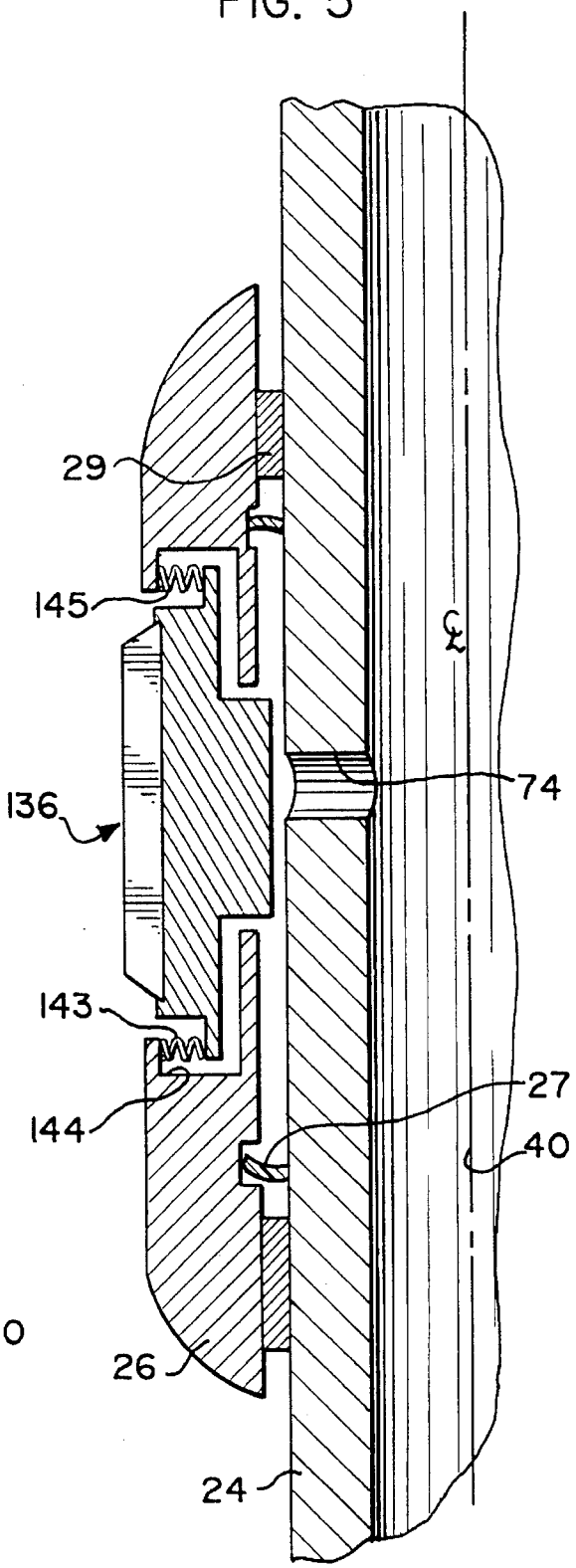

FIG. 5 illustrates another embodiment of a borehole engaging blade 136. The body of the blade 136 is kept in the sleeve's cavity 144 by restraining tabs 145. Coil springs 143 keep the body of the blade 136 normally retracted. One important advantage of this arrangement is that the normally retracted blade facilitates moving the drillstring into and out of the borehole 12. A retracted blade is also less susceptible to damage. It also is less likely to jam into sticky formation materials. Still another advantage is that it provides better gripping action through borehole wall irregularities than long fin-like blades.

Figure 6:
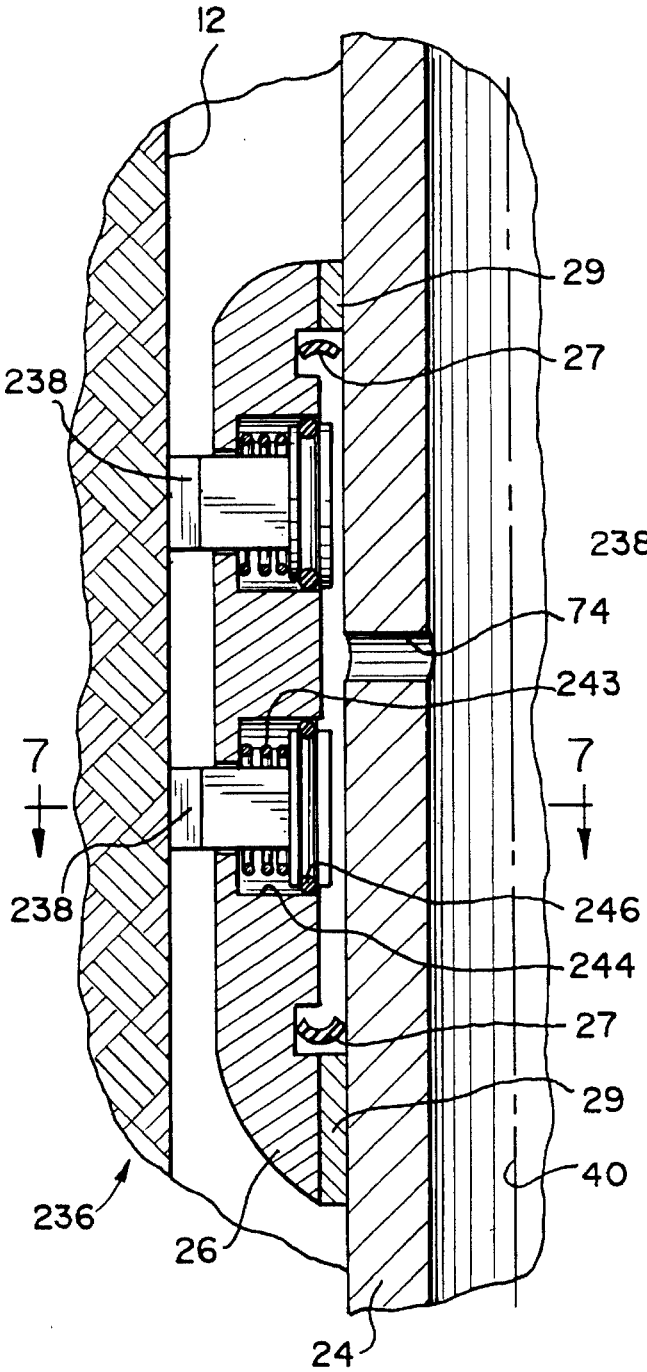
Figure 7:
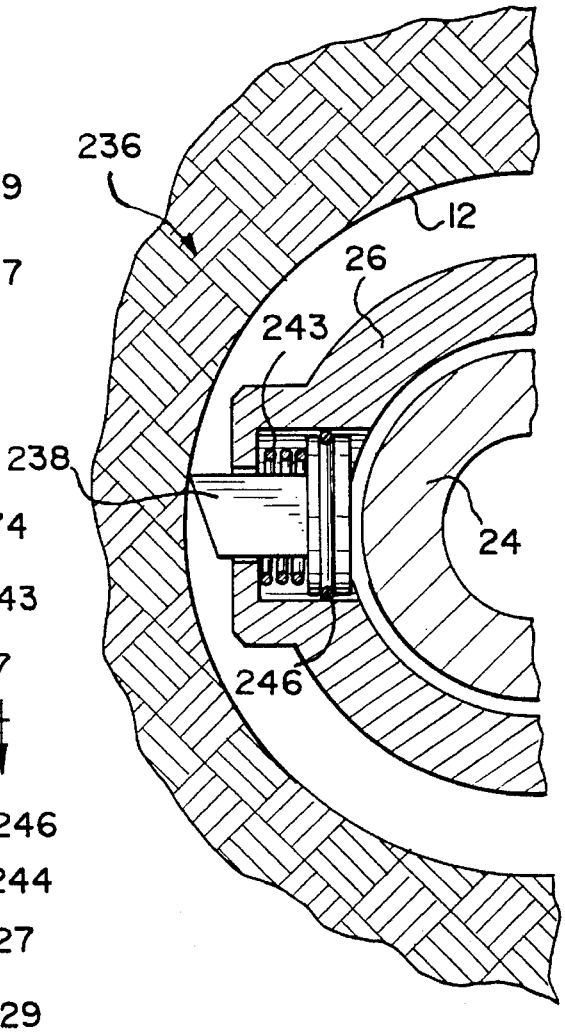
FIG. 7 is a partial cross-sectional plan view of the blade of FIG. 6 as viewed along line 7—7.

FIGS. 6 and 7 illustrate still another embodiment 236. Here a plurality of axially aligned blades 238 are shown. Each blade has a piston-shaped proximate end that fits within a cylindrical cavity 244. The opposite or outer end is shaped like a half wedge to provide a large resistance to sliding in one direction and relatively low resistance in the opposite direction (See FIG. 7). Preferably, the distal or outside ends of the blades should have a cross-section (i.e., flat, keyed or rectangular) that prevents the piston from rotating within its cavity.

The blades of FIGS. 5, 6, and 7 operate differently than the blades of FIG. 3. In particular, drilling fluid pressure is needed to extend the blades while the force of the springs is used to retract the blades.

Those skilled in the art will appreciate that the present invention may be combined with other curve drilling inventions. For example, U.S. Pat. No. 4,948,925 to Winters, Burton, Warren and Brett (and assigned to Amoco Corporation) describes a downhole drilling assembly orienting device. Those teachings are incorporated by reference. In that invention, rotation of a downhole steering assembly is monitored by means of a drill sub that has a drilling fluid port (i.e., orientation signal port) which is plugged when the eccentric collar or sleeve 26 is at a predetermined orientation. This signal port is located downhole of the blade activating valve plug 61. The plugging of the signal port increases the pressure of the drilling fluid in the drill string. Therefore, by monitoring drilling fluid pressure at the wellhead, one can ascertain the orientation of the downhole assembly. However, since this signal port is below the blade activating plug 61, all the drilling fluid must pass through the plug. Therefore, when the flow rate is increased to shift the plug to extend the blades, the surface pump pressure increases. The pressure rises even more as the pressure control element 70 partially blocks the hole in the plug. This added rise in pressure could exceed the capability of the surface pumping equipment. Therefore, if the drillstring is first orientated such that the signal port is open (with the drillstring not rotating) before the plug is shifted, the surface pressure will not need to be raised to as high a level as it would if the port were closed. After the plug is moved down to extend the blade, the flow rate can be reduced back to its original level. Pump pressure will remain higher when rotation of the drillstring is resumed than it was before the plug was shifted, but the shifting pressure will be less than if the signal port were closed during the shifting operation.

Figure 8:
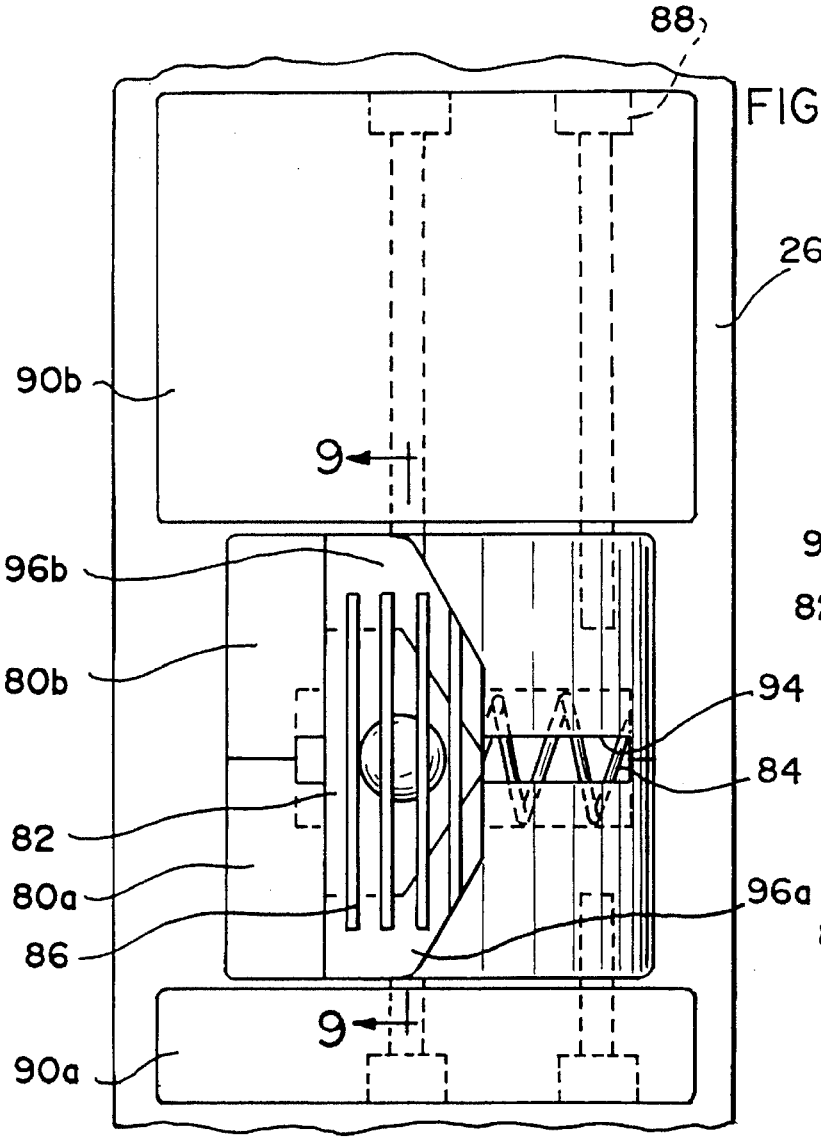
FIG. 8 is a side elevational view of an improved borehole engaging means.
Figure 9:
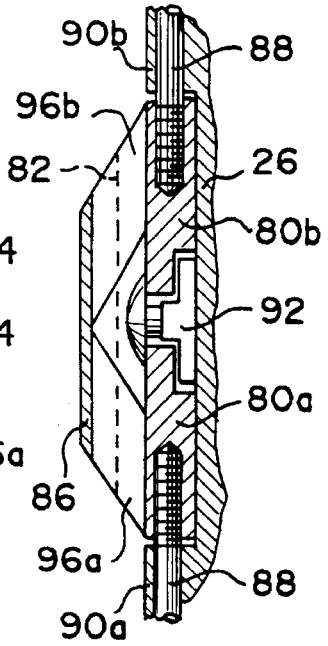
FIG. 9 is a cross-sectional view of the engaging means of FIG. 8 as viewed along line 9—9.
Figure 10:
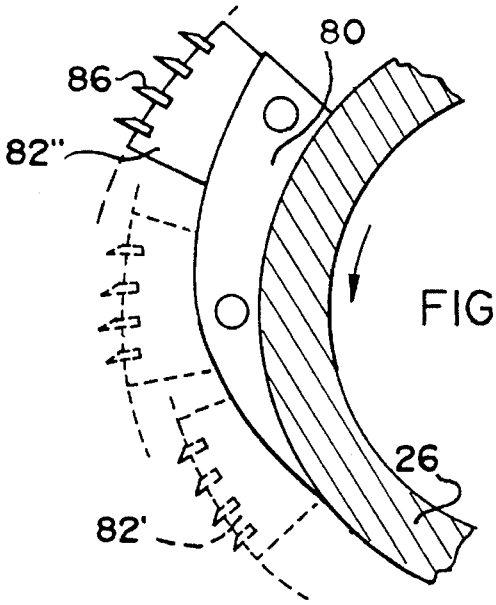
FIG. 10 is a schematic diagram illustrating the operation of the engaging means of FIG. 9.

Turning now to FIGS. 8, 9 and 10, another embodiment of a borehole engaging device is illustrated. Here the gripping device comprises a ramp 80, a drag block 82, a biasing spring 84, and a plurality of gripping elements 86. The ramp 80 is formed from two ramp halves or sections 80*a* and 80*b* which are held in place by means of bolts 88 that fit within bores formed within brackets 90*a* and 90*b* on the exterior of the eccentric collar 26. The drag block 82 slides on the exterior of the ramp 80 and is guided in movement by means of a key 92 that fits within a guide slot 94 formed by the two ramp sections 80*a* and 80*b*. The exterior of the drag block 82 is beveled on its uphole end 96*b* and on its downhole end 96*a*. These beveled ends help retract the drag block 82 when the curve drilling assembly is tripped into and out of the wellbore. The drag block 82 is preloaded with a mild steel spring 84 located in the guide slot 94. The spring 84 acts to force the drag block 82 up the ramp 80 to make initial contact with the borehole walls. Thereafter, the drag block 82 becomes self energized if the eccentric sleeve tries to slip to the right (i.e., counter-clockwise according to the orientation of FIG. 10). Preferably the gripping elements 86 are made of tungsten carbide and have sharp edges or points that protrude (e.g., about 1/16 inch) to penetrate the walls of the borehole. In one embodiment, the drag block 82' (See FIG. 10) extends about 3 and 7/8 inches from the base of the eccentric sleeve 26 when fully retracted. When fully extended, the drag block 82" raises about 5/8 inches.

Now that all of the components of the invention have been described, the use of the invention will be summarized. When it is determined that the eccentric sleeve needs to be reoriented, the pressure of the drilling fluid is increased to cause the blade control valve 64 to open. This causes the moveable borehole engaging blade 36 to extend and contact the borehole walls. Thereafter, drilling fluid pressure can be returned to its normal value and the drill string can be moved axially in the borehole (e.g., drilling ahead with the blade 36 extended). The angle on the blade induces rotation of the eccentric sleeve, much like the threads of a lead screw. Alternatively, the eccentric sleeve can be re-oriented by first raising the drill string, increasing drilling fluid pressure thereby raising the movable blade, and then lowering the drill string with the blade extended. Once the sleeve is rotated to the desired orientation the blade is retracted.

The present invention may also be used alternatively to drill a straight path and to drill a curved path in the lateral portion of the well. If the skewed blade 36 is extended and left extended as the drillstring is advanced during drilling, the eccentric sleeve will slowly precess around the axis of the rotating mandrel. This will have the effect of causing the drill bit (on average) to drill along a straight path, although at any instant in time it is drilling a curved path. The well path will actually be a very tight spiral, but the pitch of the spiral is such that it has no effect on the wellbore. When it is desired to change the lateral heading, in either inclination or direction, the skewed blade is retracted and the eccentric sleeve is oriented to point the bit in the direction of the desired path. Since the skewed blade is not extended, the eccentric sleeve remains in a fixed orientation as the drillstring is rotated and the hole extended. When so used, it may be desirable to use a smaller eccentricity so that the radius of curvature drilled is longer than when drilling the curved part of the well. After the well is aimed in the new direction, the skewed blade is extended and the well then drills along a "straight" path.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made in the shape, materials, size and arrangement of parts. For example, the blade 30 shown in FIG. 4 may be skewed relative to the center axis 40. Parts may also be reversed and certain features of the invention may be used independently of other features of the invention. Moreover, equivalent elements may be substituted for those illustrated and described. For example, although the drawings illustrate one fluid-movable blade, the eccentric sleeve may be provided with a plurality of movable blades. Moreover those blades may be mounted axially (e.g., FIG. 6) radially or in any combination. Similarly, the normal anti-rotation blades 30 may be operated hydraulicly as well. Mud pressure could be applied to retract these normally outward projecting blades. Thus, it will be appreciated that various modifications, alternatives, variations, and changes may be made without departing from the spirit and scope of the invention as defined in the appended claims. It is, of course, intended to cover by the appended claims all such modifications involved within the scope of the claims.

We claim:

1. In a curve drilling assembly having a bored mandrel rotatably mounted within a cylindrical housing, an orientation control mechanism comprising:

a) a blade having a distal borehole engaging inclined edge and having a proximate end surface, said engaging edge lying in a plane that is at an angle relative to the longitudinal axis of the housing, said housing having a cavity for sealingly carrying said blade for movement towards and away from said longitudinal axis;

b) passage-way means, carried by the mandrel, for ducting fluid from the interior of the mandrel and into said cavity, said passage-way means having an entry port at the interior of the mandrel;

c) sliding means, slidingly mounted within the bore of the mandrel between a raised position and a lowered position, for respectively closing and opening said entry port;

d) biasing means, carried by the mandrel, for biasing said sliding means to said raised position;

e) pressure activated means, carried within said bore, for overcoming said biasing means and moving said sliding means to said lowered position in response to increasing the pressure of said fluid supplied to said bore by a predetermined amount above a nominal value, said pressure activated means having an opening through which said drilling fluid passes in flowing between the ends of the mandrel; and f) pressure control means, carried within said bore of the mandrel, for partially plugging said opening and increasing the pressure within said bore to at least said predetermined amount when said sliding means is in its lowered position so as to keep said entry port open after the pressure of said fluid supplied to said bore returns to said nominal value.

2. The mechanism of claim 1, wherein the mandrel has an uphole end and is connected to a flexible joint at its uphole end; and wherein said edge of said blade is generally straight.

3. The mechanism of claim 1, wherein the mandrel is eccentrically mounted relative to the longitudinal axis of the housing.

4. The mechanism of claim 1, further including at least one spring-loaded blade at the exterior of said housing for engaging the walls of the borehole and preventing rotation of said housing relative to the axis of the borehole.

5. The mechanism of claim 1, wherein the mandrel and the housing have fluid ports that are aligned when the mandrel and the housing are at a predetermined relative angular orientation such that fluid passes from said bore of the mandrel to said cavity in said housing after said sliding means is moved to said lowered position.

6. A method for orienting an eccentric sleeve of a curve drilling apparatus, comprising the steps of:

a) mounting, within a cavity located within a sleeve, a blade-like member having a distal generally straight edge and having a proximate end surface, said cavity having an aperture therein for receiving a source of drilling fluid, said cavity and said proximate end surface defining a chamber, said edge lying in a plane that is at an angle to the longitudinal axis of said sleeve such that, when said edge engages the borehole walls and said sleeve is rotated in the clockwise direction as viewed from the up-hole end of said sleeve, said sleeve is driven upwardly in the borehole, said cavity sealingly carrying said proximate end surface of said blade-like member within said cavity for movement towards and away from said longitudinal axis in response to the introduction of drilling fluid into said cavity and against said end surface of said blade-like member;

b) mounting a drill pipe mandrel within said sleeve, said drill pipe mandrel having two opposite ends, having an interior between said ends and having at least one of said ends adapted to be connected to a string of drill pipe having drilling fluid supplied thereto;

c) using a drilling fluid pressure responsive valve that is carried by said mandrel to duct drilling fluid from said interior of said mandrel through said aperture and into said cavity to move said blade-like member into engaging contact with the walls of a curved borehole;

d) lowering said string of drill pipe into the borehole to induce said sleeve to rotate counter-clockwise; and e) moving said blade-like member out of engaging contact with said wall of said borehole after said sleeve has moved downwardly within said borehole by a pre-determined distance.

7. The method of claim 6, where step (c) is performed by using a passageway that is carried by at least one of said mandrel and said sleeve and that ducts drilling fluid from said interior of said mandrel through said aperture and into said chamber, said passageway having an entry port at said interior of said mandrel.

8. The method of claim 7, where step (c) is performed by using a valve comprising:

c) a sliding plug, slidingly mounted within said interior of said mandrel for movement between a raised position and a lowered position, for respectively closing and opening said entry port;

d) biasing means, carried by said mandrel, for biasing said sliding plug to its raised position; and e) pressure activated means, carried within said interior of said mandrel, for overcoming said biasing means and moving said plug to its lowered position in response to increasing the pressure of said drilling fluid supplied to said interior of said mandrel by a pre-determined amount above a nominal pressure value, said pressure activated means having an opening through which said drilling fluid passes in flowing between said two ends of said mandrel.

9. The method of claim 8, wherein said valve comprises pressure control means, carried within said interior of said mandrel, for partially plugging said opening and increasing the pressure within said interior to at least said pre-determined amount when said sliding plug is in its lowered position so as to keep said entry port open after the pressure of said fluid supplied to said interior returns to said nominal pressure value.

10. A method for orienting an eccentric sleeve of a curve drilling apparatus, comprising the steps of:

a) mounting, within a cavity located in the sleeve, a member having a distal generally straight edge and having a proximate end, said edge lying in a flat plane that is at an angle to the longitudinal axis of the sleeve such that rotation of the sleeve in the clockwise direction when viewed from the up-hole end of the sleeve drives said sleeve upwardly in the borehole, said cavity sealingly carrying said proximate end of said member within said cavity for movement towards and away from said longitudinal axis in response to the introduction of fluid into said cavity and against said end surface of said member;

b) mounting a drill pipe mandrel within the sleeve;

c) positioning said mandrel, the sleeve and the attached drill pipe within the walls of a borehole;

d) raising the drill pipe, the sleeve and said mandrel within said borehole by a pre-determined distance;

e) using a pressure responsive valve that is carried by said mandrel to duct fluid from the interior of said drill pipe into said cavity to move said member into engaging contact with the walls of said borehole;

f) lowering the drill pipe, the sleeve and said mandrel back into said borehole by approximately said pre-determined distance, whereby the sleeve is induced to rotate in the counter-clockwise direction; and g) moving said member out of engagement with said wall of said borehole.

11. The method of claim 10, wherein step (e) is performed by using a pressure responsive valve comprising:

a) a plug, slidingly mounted within said interior of said mandrel for respectively closing and opening a passage-way joining the interior of said mandrel and said cavity;

b) biasing means, carried by the mandrel, for biasing said plug to its closed position;

c) pressure activated means, carried within said interior of said mandrel, for overcoming said biasing means and moving said plug to its opened position in response to increasing the pressure of said fluid supplied to said interior of said mandrel, by a pre-determined amount above a nominal value, said pressure activated means having an opening through which said fluid passes in flowing between said ends of said mandrel; and d) pressure control means, carried within said interior of said mandrel, for partially plugging said opening of said pressure activated means and increasing the pressure within said interior of said mandrel to at least said pre-determined amount when said plug is open so as to keep said passage-way pressurized after the pressure of said fluid supplied to said interior of said mandrel returns to said nominal value.

12. A method for shifting modes of operation of a short-radius curve drilling apparatus from a steering mode to a straight drilling mode, the apparatus comprising a generally cylindrical sleeve that is located within a curved borehole and a drill pipe mandrel that is eccentrically carried within the sleeve, the method comprising the steps of:

a) mounting, within a cavity located in said sleeve, a drilling fluid powered borehole engaging, counter-clockwise rotation inducing blade, said blade being mounted for movement towards and away from the exterior of the sleeve and having a distal edge that is inclined at an angle to a flat plane containing the axis of said cylindrical sleeve to define a pitch less than thirty feet;

b) locating within said mandrel a drilling fluid pressure responsive valve for ducting drilling fluid from the interior of said mandrel to said cavity to operate said blade;

c) opening said valve to have said blade engage the walls of the curved borehole; and d) axially moving said drill string within the borehole to induce rotation of said sleeve and lateral translation of said mandrel from a first position to a second position, said eccentrically mounted drill pipe mandrel when in said first position being located along an outside portion of a curved section of a wellbore, said eccentrically mounted drill pipe mandrel when in said second position being located along an inside portion of said curved section of said wellbore.

13. In a curve drilling assembly having a cylindrical sleeve that is rotatably mounted about a mandrel for orientating a drill string carried by the sleeve, apparatus comprising:

a) a drilling fluid powered blade that is carried by the sleeve for moving to engage the walls of a curved borehole and inducing counter-clockwise rotation of the sleeve when the drill string is axially moved in the borehole; and b) valve means, carried by the mandrel, for moving the blade towards said walls by introducing pressurized drilling fluid from the interior of a drill string and into said sleeve.

14. The apparatus of claim 13, wherein said blade has a distal borehole engaging and generally straight edge and a proximate end surface, said engaging edge lying in a plane that is at an angle to the longitudinal axis of the sleeve, the sleeve having a cavity for sealingly carrying said end surface of blade for movement towards and away from said longitudinal axis; and wherein the mandrel has a passage-way that connects the interior of the mandrel to a port in the sleeve that leads into said cavity.

15. The apparatus of claim 14, wherein said angle of engaging edge of said blade defines a pitch of less than thirty feet.

16. The apparatus of claim 14, wherein said valve comprises:

a) sliding means, slidingly mounted within the bore of the mandrel between a raised position and a lowered position, for respectively closing and opening said passage-way;

b) biasing means, carried by the mandrel, for biasing said sliding means to said raised position; and c) pressure activated means, carried within said bore of the mandrel, for overcoming said biasing means and moving said sliding means to said lowered position in response to increasing the pressure of said fluid supplied to said bore by a pre-determined amount above a nominal value, said pressure activated means having an opening through which said drilling fluid passes in flowing between the ends of the mandrel.

17. The apparatus of claim 16, further including pressure control means, carried within said bore of the mandrel, for partially plugging said opening of said pressure activated means and increasing the pressure within said bore to at least said pre-determined amount when said sliding means is in its lowered position so as to keep said passage-way open after the pressure of said fluid supplied to said bore returns to said nominal value.

18. The apparatus of claim 13, wherein the mandrel is connected to a flexible joint at its uphole end; and wherein the mandrel is eccentrically mounted relative to the longitudinal axis of the sleeve.

19. The apparatus of claim 13, further including at least one spring-loaded blade at the exterior of the sleeve for engaging the walls of the borehole and preventing rotation of the sleeve relative to said borehole.

20. The apparatus of claim 13, wherein the mandrel and the sleeve have generally radial fluid ports that are in fluid communication with each other when the mandrel and the sleeve are at a pre-determined relative angular orientation such that fluid passes from said bore of the mandrel and into the sleeve; and wherein the mandrel and the sleeve are located in said pre-determined position prior to said pressure being increased in said bore of the mandrel.

* * * * *